US006306568B1

(12) United States Patent
Brady et al.

(10) Patent No.: US 6,306,568 B1
(45) Date of Patent: Oct. 23, 2001

(54) FILM SUPPORT WITH IMPROVED ADHESION UPON ANNEALING

(75) Inventors: Brian K. Brady, North Chili; Charles L. Bauer, Webster, both of NY (US); Dennis J. Eichorst, Lenexa, KS (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,116

(22) Filed: Dec. 29, 2000

(51) Int. Cl.[7] ..... G03C 1/85; G03C 1/30; G03C 1/795; G03C 7/24

(52) U.S. Cl. ..... 430/527; 430/349; 430/531; 430/533; 428/480; 428/481; 428/532

(58) Field of Search ..... 430/531, 349, 430/533, 527; 428/480, 481, 532

(56) References Cited

U.S. PATENT DOCUMENTS

| | | | | |
|---|---|---|---|---|
| 2,627,088 | | 2/1953 | Alles et al. | 430/533 |
| 2,779,684 | | 1/1957 | Alles | 430/533 |
| 3,143,421 | | 8/1964 | Nadeau et al. | 430/533 |
| 4,225,665 | | 9/1980 | Schadt, III | 430/529 |
| 5,198,499 | | 3/1993 | Anderson et al. | 525/201 |
| 5,427,900 | | 6/1995 | James et al. | 430/496 |
| 5,432,050 | | 7/1995 | James et al. | 430/496 |
| 5,580,707 | | 12/1996 | Kawamoto | 430/496 |
| 5,719,016 | | 2/1998 | Christian et al. | 430/530 |
| 5,766,835 | * | 6/1998 | Matsunaga | 430/531 |

* cited by examiner

*Primary Examiner*—Richard L. Schilling
(74) *Attorney, Agent, or Firm*—Doreen M. Wells

(57) ABSTRACT

A photographic element comprising a polyester support; an antistatic layer; and a transparent magnetic layer comprising a cellulose binder, ferromagnetic particles and a blocked isocyanate.

1 Claim, No Drawings

FILM SUPPORT WITH IMPROVED ADHESION UPON ANNEALING

CROSS REFERENCE TO RELATED APPLICATIONS

This application relates to commonly assigned copending application Ser. No. 09/751,114, ANNEALABLE IMAGING SUPPORT CONTAINING AN ANTISTATIC LAYER filed simultaneously herewith. This application relates to commonly assigned copending application Ser. No. 09/751,550, AMINE MODIFIED GELATIN LAYER FOR IMPROVED ADHESION OF PHOTOGRAPHIC ELEMENTS AFTER ANNEALING filed simultaneously herewith. This application relates to commonly assigned copending application Ser. No. 09/751,724, FILM SUPPORT WITH ANNEALABLE LAYER AND IMPROVED ADHESION filed simultaneously herewith. This application relates to commonly assigned copending application Ser. No. 09/751,725, ANNEALABLE IMAGING SUPPORT CONTAINING A GELATIN SUBBING LAYER AND AN ANTISTATIC LAYER filed simultaneously herewith.

FIELD OF THE INVENTION

The present invention relates to light sensitive imaging elements in general and in particular to film supports whose ability to adhere to other layers is improved upon annealing.

BACKGROUND OF THE INVENTION

Because of curl and core-set specifications, an advanced photo system (APS) film uses a polyethylene naphthalate based support that must be annealed before applying the emulsion layers. The film support can be prepared by purchasing oriented PEN base, annealing the base, and then applying the adhesive (subbing) and backing layers forming the following structure:

| |
|---|
| Gel based sub |
| adhesion layer |
| PEN support |
| adhesive layer |
| antistat/binder |
| magnetics layer |
| lubricant |

To reduce manufacturing costs it would be desirable to manufacture the PEN support and apply as many of the support coatings in-line with the base manufacturing before annealing in a wound roll format. The current magnetics coated support undergoes degradation with annealing resulting in poor magnetics layer adhesion. One method of improving adhesion is the addition of crosslinking agents to the magnetics layer, such as isocyanates, a known skin and respiratory sensitizor. Because of health and safety concerns with handling isocyanates it is desirable to use an alternative crosslinking agent. We have found that good adhesion can be achieved by the use of heat activated blocked isocyanates in the magnetics layer. These materials will crosslink the coating during the annealing stage of manufacturing (application of heat over a long period of time). The added advantage of these materials is that they do not react at room temperature and thereby extend the life of a coating solution and provide easy clean-up.

U.S. Pat. No. 4,225,665 describes an antistat layer that contains a carboxylic acid functionalized polymer which is crosslinked with aziridine.

U.S. Pat. No. 5,198,499 describes an antistat layer that is crosslinked with a melamine which provides good abrasion resistance, adhesion and antistatic properties.

U.S. Pat. No. 5,427,900 decries a photographic film with a magnetics layer on the backside. The preferred binder for the magnetics layer is cellulose diacetate which may be crosslinked with isocyanates, aziridines or melamines.

U.S. Pat. No. 5,432,050 describes a magnetics layer with filler particles which may be crosslinked with isocyanates, aziridines or melamines.

If the magnetics package is applied before the annealing process, the adhesion of the backings is degraded because of the annealing process. It would be advantageous to coat as many backside layers as possible in-line before annealing.

SUMMARY OF THE INVENTION

The present invention discloses that by adding blocked isocyanates to the magnetics layer and then annealing the package results in good adhesion. This allows the manufacture of a polyester support to be coated in-line with several backing layers. Hence, the present invention describes: A photographic element comprising:

- a polyester support;
- an antistatic layer, and
- a transparent magnetic layer comprising a cellulose binder, ferromagnetic particles and a blocked isocyanate.

The advantages of the invention are many. The use of blocked isocyanate for an annealable backing package gives good adhesion to preferred antistatic layer or non-blocking protective layers. Significant manufacturing and environmental advantages are offered compared with conventional isocyanate cross-linkers since the blocked isocyanates do not react at room temperature. In particular, blocked isocyanates can extend coating solution life, provide easy clean-up and reduce operator exposure to reactive chemistries. To date, cross-linking the magnetic layer has been the only method found to provide an annealable magnetic backing having a cellulose diacetate magnetic layer and a vanadium oxide antistatic layer.

DETAILED DESCRIPTION OF THE INVENTION

The imaging support of this invention is suitable for use in various imaging elements including, for example, photographic, electrostatographic, photothermographic, migration, electrothermographic, dielectric recording, and thermal dye transfer imaging elements. Details with respect to the composition and function of this wide variety of imaging elements are provided in U.S. Pat. No. 5,719,016. Imaging elements that can be provided with a support in accordance with this invention can differ widely in structure and composition. For example, they can vary in regard to the type of support, the number and composition of the image forming layers, and the number and kinds of auxiliary layers included in the elements. The image forming layer(s) of a typical photographic imaging element includes a radiation sensitive agent (e.g., silver halide) dispersed in a hydrophilic water-permeable colloid. Suitable hydrophilic colloids include both naturally-occurring substances such as proteins, for example, gelatin, gelatin derivatives, cellulose derivatives, polysaccharides such as dextran, gum arabic, and the like; as well as synthetic polymers, for example, water-soluble polyvinyl compounds such as poly (vinylpyrrolidone), acrylamide polymers, and the like. A common example of an image-forming photographic layer is a gelatin-silver halide emulsion layer. In particular, the photographic elements can be still films, motion picture films, x-ray films, graphic arts films or microfiche. They can be black-and-white elements, color elements adapted for use in negative-positive process or color elements adapted for use in a reversal process.

Polymer film supports which are useful for the present invention include polyester supports such as -1,4-cyclohexanedimethylene tereplithalate, polyethylene 1,2-diphenoxyethane-4,4'-dicarboxylate, polybutylene tereplithalate, and polyethylene naphthalate and the like; and blends or laminates thereof. Particularly preferred are polyethylene naphthalate and blends of polyethylene naphthalate with polyethylene tereplithalate. Additional suitable polyester supports, polyester copolymers and polyester blends are disclosed in detail in U.S. Pat. No. 5,580,707.

Film supports can be surface-treated on either or both sides prior to application of the gelatin subbing layer by various processes including corona discharge, glow discharge, LTV exposure, flame treatment, electron-beam treatment or treatment with adhesion-promoting agents including dichloroacetic acid and trichloroacetic acid, phenol derivatives such as resorcinol and p-chloro-m-cresol, solvent washing prior to overcoating with a subbing layer of the present invention. In addition to surface treatment or treatment with adhesion promoting agents, additional adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like may be applied to the polyester support. Particularly preferred primer or tie layers comprise a chlorine containing latex or solvent coatable chlorine containing polymeric layer. Vinyl chloride and vinylidene chloride containing polymers are preferred as primer or subbing layers of the present invention.

The subbing or primer composition may be applied to the polyester base using an in-line process during the base manufacture or by an off-line process. When applied in an in-line process, the layer may be coated on the polyester base prior to orientation, after orientation, or after uniaxial orientation but before biaxial orientation. The primer composition described is typically applied in accordance with U.S. Pat. Nos. 2,627,088 and 3,143,421. The coating formulation is coated onto the amorphous support material, dried, and then the resulting film is oriented by stretching and other steps applied to the film such as heat setting, as described in detail in U.S. Pat. No. 2,779,684. Accordingly, the particular support film used, the procedure and apparatus for the coating thereof and the orientation of the film are not limitations of the present invention. Any of the usual coating apparatus and processing steps employed in the art may be employed in treating the film product of the present invention. For the imaging side of the support, a hydrophilic subbing layer containing the amine modified gelatin of the invention is applied to the polyester film base prior to heat-treatment. The subbing layer may be applied to a polyester support which has been surface treated or be superposed on any suitable primer layer. A preferred subbing layer for the imaging side of the support is described in U.S. Ser. No. 09/067,306 incorporated by reference herein. The gelatin subbing layer is typically used in an amount of from 0.25 to 5 weight percent, preferably 0.5 to 1 weight percent. The subbing layer may include addenda such as dispersants, surface active agents, plasticizers, coalescing aids, solvents, co-binders, soluble dyes, solid particle dyes, haze reducing agents, adhesion promoting agents, hardeners, antistatic agents, matting agents, etc. For altering the coating and drying characteristics it is a common practice in the art to use surface active agents (coating aids) or to include a water miscible solvent in an aqueous dispersion. Suitable solvents include ketones such as acetone or methyl ethyl ketone, and alcohols such as ethanol, methanol, isopropanol, n-propanol, and butanol. Underlying subbing, primer or tie layers may also be surface treated, for example by corona discharge treatment, to aid wetting by the gelatin subbing formulation.

Coated supports in accordance with the present invention are subjected to an extended heat treatment or annealing step after conventional support film manufacturing heat treatment to reduce core-set curling tendencies of the support. Such "post manufacture" heat tempering or annealing includes heating the coated film support at a temperature that is 50 to 5° C. less than the glass transition temperature of the support for at least 6 hours. The heat tempering or annealing step for reducing core-set curling tendencies is distinguishable from typical support manufacturing heat treatment in that it is performed after the support is wound on a roll rather than as part of the primary support manufacturing process. In a preferred embodiment of the present invention, the imaging support consists of a polyethylene-2,6-naphthalate film base which is coated with vinylidene chloride primer layers. A modified gelatin subbing layer is applied on one side of the support. With respect to polyethylene-2,6naphthalate, the Tg is about 140 deg. C., and the heat treatment temperature is from 90 deg. C. to 120 deg. C., preferably from 100 deg. C. to 115 deg. C., and more preferably from 105 deg. C. to 115 deg. C.

Photographic elements in accordance with the preferred embodiment of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming; units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dyeforming coupler, magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

The present invention is illustrated by the following detailed examples of its practice. However, the scope of this invention is by no means limited to these illustrative examples.

EXAMPLES

Example 1

For the following examples, a thick sheet of polyethylene naphthalate (PEN) was melt extruded, a poly(acrylonitrile-co-vinylidene chloride-co-acrylic acid) (NVcC) adhesion promoting layer was applied to both sides of the support. The support was then stretched and tentered forming a 102 micron thick PEN film with approximately 60 nm thick layer of NVcC. To one side of the support was applied approximately 0.09 g/m$^2$ of a gelatin subbing layer. On the side opposite the gelatin subbing layer an antistat layer was applied from water. For one example the antistat layer, designated A1 is a two layered structure with the first layer comprising poly(acrylonitrile-co-vinylidene chloride-co-acrylic acid): vanadium pentoxide: Tx-100 at a 1:1:1 wt ratio, 0.015 g/m$^2$ dry, and the second layer comprising a mixture of hydroxypropyl methyl cellulose (E3 Premium, Dow Chemical) and a polyurethane, Witcobond W236 (Witco Corp), 25/75 wt. ratio, 0.22 g/m$^2$ dry coverage. For the other examples the antistat layer, designated A2, is a layer comprising a mixture of zinc antimonate and gelation (90/10 wt. ratio) at 0.605 g/m$^2$ dry coverage.

On top of the antistat layer, a magnetics layer was applied as described in Table 1. This layer was coated from a solvent mixture of dichloromethane/acetone/methylacetoacetate at a wet coverage of 44.1 cc/m$^2$ and then dried. Before coating, a blocked isocyanate, BL-3175A from Bayer Chem., was added to the coating solution at levels indicated in Table 2 (as % based on total solids in the coating).

TABLE 1

| Component | Percent of solution |
|---|---|
| cellulose diacetate | 2.85 |
| Toda CSF 4085V2 magnetic particles | 0.13 |
| cellulose triacetate | 0.128 |
| dibutylphthalate | 0.153 |
| Gafac PB510 | 0.006 |
| FC431 surfactant from 3M | 0.015 |
| Solsperse | 0.006 |
| AKP-50 abrasive particles | 0.117 |

TABLE 2

| | | | Unannealed | | Annealed | |
|---|---|---|---|---|---|---|
| Sample | Antistat | % BL-3175 used | Dry Adhesion (% removed) | Wet Adhesion (% removed) | Dry Adhesion (% removed) | Wet Adhesion (% removed) |
| B | A1 | 10 | 100 | 100 | 4 | <1 |
| C | A2 | 10 | 100 | 85 | 0 | 3 |
| D | A2 | 20 | 100 | 75 | 0.5 | <2 |

The coatings were wound onto a 6 inch core and placed in an oven for 3 days at 100° C. and then 2 days at 100° C. To evaluate adhesion both wet and dry tests were performed and results are given in Table 2 for before and after annealing:

Dry: 610 Scotch Tape Test=the coating is scored with a razor blade in a grid pattern (5 one inch lines, 0.2 inches apart and another 5 at a 45 degree angle to the first set). A piece a 610 Scotch tape is applied over the scored area and the tape is pulled off by hand. This is repeated ten times with a fresh piece of tape. The amount of removal is then assessed given in units of % removed.

Wet: AO abrasion=a 35 mm strip of the coating is soaked at 100F. for 3 min 15 sec. in a developer bath. The strip is then scored with a razor blade and placed in a small trough, and a weighted rubber pad is placed on top. The pad is moved back and forth across the strip 100 times. The amount of removal is then assessed given in units of % removed. The results from tables 2 show that after annealing the adhesion of the layers is greatly improved.

Example 2

In this set of examples the amount and type of block isocyanate in the magnetics layer was varied. The support was generated in the same manner in the examples above except the antistat layer used, designated A3, is a layer comprising a mixture of zinc antimonate and gelation (80/20 wt. ratio) at 0.605 g/m$^2$ dry coverage. The magnetics layer was prepared and tested as in Example 1 but with the amount and type of blocked isocyanate crosslink varying as described in Table 3. The amount of crosslinker added is given as a percent based on the total solids in the coating solution.

TABLE 3

| | | | Annealed Adhesion | | |
|---|---|---|---|---|---|
| Sample | Crosslinker | % Cross-linker | Dry Adhesion (% removed) | Wet Adhesion (% removed) | |
| E | none | 0 | 0 | 30 | comparison |
| F | BL-3175A* | 10 | 0 | 0 | invention |
| G | BL-3175A* | 15 | 0 | 0 | invention |
| H | BF1540** | 15 | 0 | 0 | invention |
| I | BF1540** | 20 | 0 | 0 | invention |
| J | B1358/100** | 10 | 0 | 0 | invention |
| K | B1370** | 10 | 0 | 0 | invention |
| L | DesmodurN3300++ | 10 | 0 | 0 | comparison |
| M | Cymel 303+ | 10 | 0 | 0 | comparison |

*a blocked isocyanate from Bayer Chem.
**a blocked isocyanate from Huls Chemical
++an isocyanate crosslinker from Bayer Chem.
+a melamine-formaldehyde crosslinker from Cytec These results show that blocked isocyantes after annealing are as effective as fast reacting crosslinkers (the isocyanate and the melamine-formaldehyde) in improving adhesion.

The invention has been described in detail with particular reference to certain preferred embodiments thereof, but it will be understood that variations and modifications can be effected within the spirit and scope of the invention.

What is claimed is:

1. A photographic element comprising:

a polyester support;

an antistatic layer; and a transparent magnetic layer comprising a cellulose binder, ferromagnetic particles and a blocked isocyanate.

* * * * *